United States Patent [19]

Wilen

[11] Patent Number: 4,824,503

[45] Date of Patent: Apr. 25, 1989

[54] MAGAZINE ASSEMBLY SYSTEM AND METHOD

[76] Inventor: Richard Wilen, 8 Roxbury Ct., Oakdale, N.Y. 11769

[21] Appl. No.: 79,596

[22] Filed: Jul. 30, 1987

[51] Int. Cl.[4] ..... B31F 1/08; B65H 45/20

[52] U.S. Cl. ..... 156/204; 156/252; 156/269; 156/277; 156/291; 156/324; 156/387; 156/459; 156/510; 156/548; 270/20.1; 270/21.1; 270/37; 283/67; 428/43

[58] Field of Search ..... 156/204, 252, 269, 277, 156/291, 324, 384, 387, 459, 510, 548; 270/20.1, 21.1, 37; 283/67; 428/43

[56] References Cited

U.S. PATENT DOCUMENTS

| | | | |
|---|---|---|---|
| 3,899,381 | 8/1975 | O'Brien et al. | 156/204 |
| 4,012,268 | 3/1977 | Johnson | 156/277 X |
| 4,512,845 | 4/1985 | Köbler | 156/548 |

*Primary Examiner*—Robert A. Dawson
*Attorney, Agent, or Firm*—Stephen E. Feldman

[57] ABSTRACT

Paper from a roll or other supply is processed by an in-line magazine publishing and/or assembly system. The processing sequence includes printing pages of the magazine in predetermined places on the paper, laying down patterns of glue in other places of the paper, cutting a pattern of perforations and slits in the paper related to the glue pattern, cutting the paper into two sections, one of which is folded forming the pages of the magazine. The other section is folded forming the magazine cover, including pockets defined by the glue pattern. One pocket takes the form of a tear-out remittance envelope, the other pocket taking the form of a tear-out invoice sheet. A window in the cover exposes and uses the name and address on the invoice for the magazine mailing address.

16 Claims, 5 Drawing Sheets

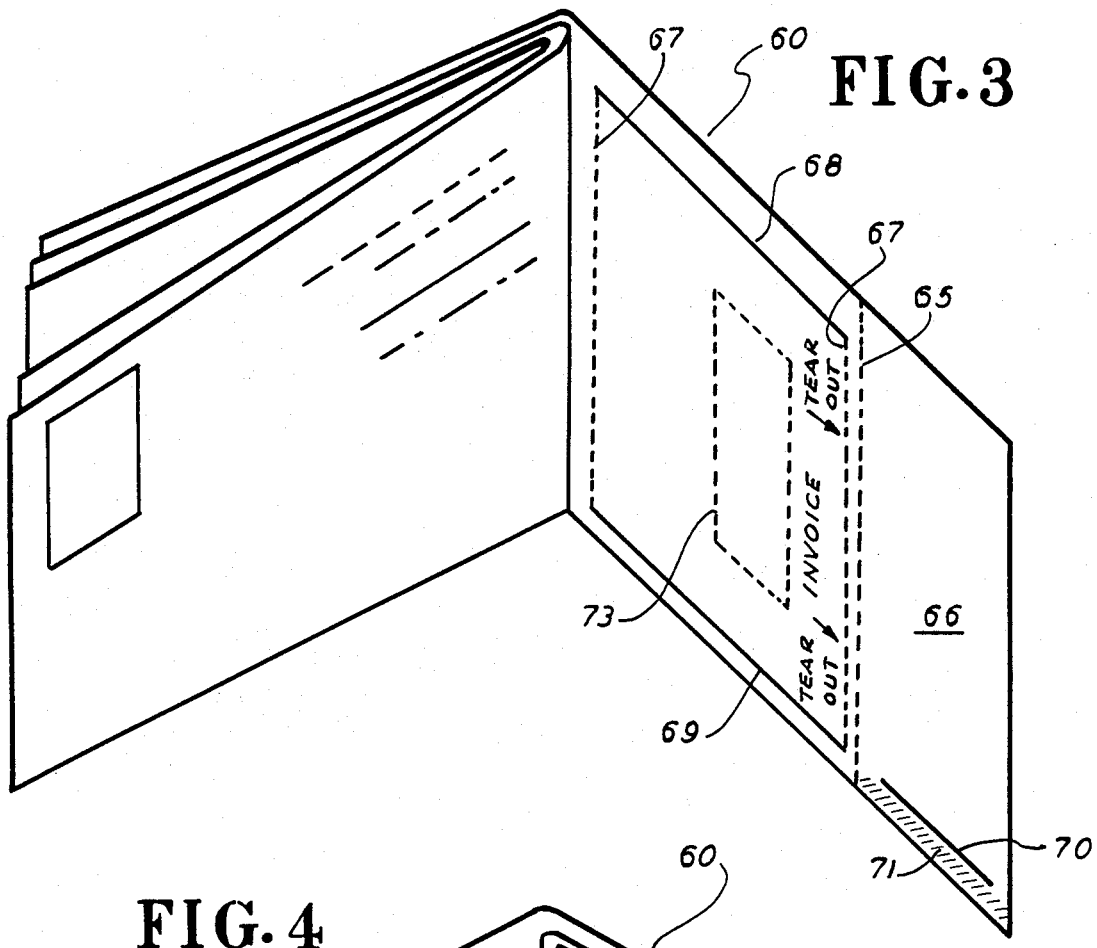
FIG. 3
FIG. 4
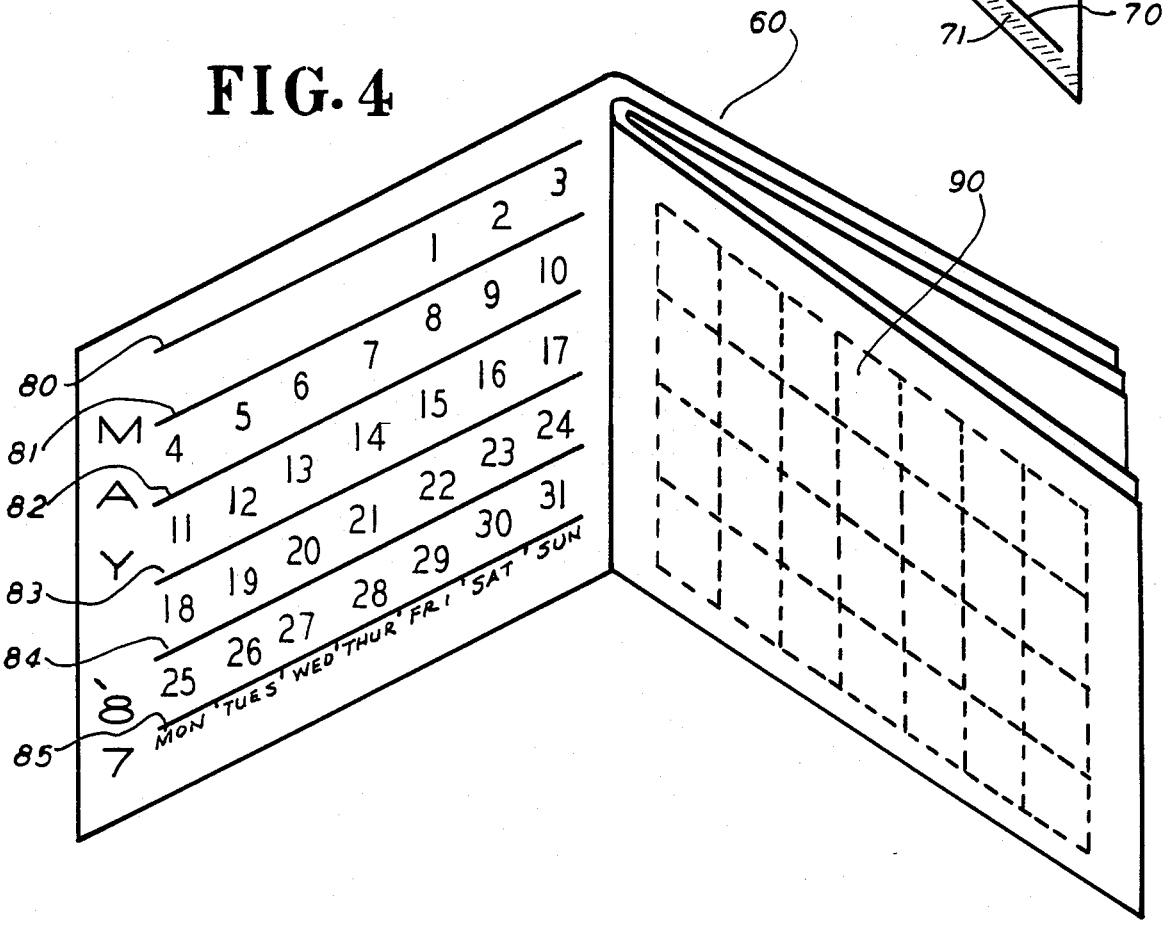

MAGAZINE ASSEMBLY SYSTEM AND METHOD

BACKGROUND OF THE INVENTION

The present invention relates to methods and apparatus for making and assembling magazines containing billing elements and envelopes. More particularly the invention relates to novel systems and apparatus for printing and assembling magazines or cataloges or booklets or other books, printing billing elements and addressing, forming and placing remittance envelopes in the magazine, catalog, booklet or other book as an integral part thereof, during the assembly thereof.

The mail order business and mail transactions have expanded at a very rapid rate. Mail order catalogs are no longer limited to the large stores having local stores throughout the country. As a method of expanding their business, single stores, such as a sporting goods store in Maine or a western tack store in Colorado or a sporting goods store in Wisconsin for example, are printing catalogs, mailing the catalogs nation wide, and are carrying on a nation wide mail order business, with a reasonable amount of success. Television has been used as a sales medium where products may be purchased via telephone and/or mail throughout most of the nation. Much of these transactions are carried out through the mail.

It is usual that the same article or product sold direct, that is, sold to a walk-in customer in the store, and sold by mail from the same store, are sold at the same price. Since the same product is sold at the same price whether the sale be a direct sale or a mail order sale, the margin of profit to the store from these different type sales differs because of the different over head costs involved.

One of the factors reducing the margin of profit for the seller in the mail order business is the cost of mail and billing the customer. The cost of mail, that is stamps is a fixed cost, fixed by the Postal Service but the billing costs, that is, providing billing elements including printed statements or invoices and return or remittance envelopes is a variable cost.

Although the billing elements are usually sent out in some form of invoice and forwarded to the purchaser as a separate sheet or sent with the purchased article, the remittance envelope is usually a separate envelope, separate from the invoice. The remittance envelope is a secure envelope provided to the purchaser for forwarding payment of the purchase made.

Paramount in the mail order business is the magazine or book subscriber business, that is where a person subscribes to a magazine or book and receives the magazine or book periodically, through the mail. In the case of a magazine or book, invoices and remittance envelopes are sent to the subscriber in several ways. Often the book is enclosed in a hard cover or box type package and the billing elements are in a separate envelope secured to the exterior of the box type package containing the book. In other cases, where the purchase is a magazine the invoice and remittance or return envelopes are often stapled or attached to the inside of the magazine.

The above defined methods of sending invoices and/or remittance envelopes are expensive and time consuming and often require additional and/or out-of-step operations from the packaging and/or assembly of the product sold.

SUMMARY OF THE INVENTION

The present invention is a novel approach in making remittance envelopes. The invention is also a novel concept which embraces the combining of billing elements, such as invoices and remittance envelops into a magazine or book with a novel in-line system for making, printing and inserting invoices and remittance envelopes into the cover of the magazine, catalog or other published and/or assembled book or booklet, hereinafter referred to generically as magazine, as an integral part of the magazine. The in-line assembly system includes printing apparatus such as off-set printing systems, for example and other magazine publishing apparatus employed in a new and novel way to make elements such as envelopes, for example, and print invoices, in a different, inexpensive and rapid manner, integrated into a magazine for example, with tear-out characteristics. The assembling and positioning of the apparatus, in in-line production fashion permits printing of both the magazine and the billing elements and the assembly of such element and their insertion into a magazine, as an integral part of the magazine but with tear-out characteristics. Some of the in-line apparatus is normally used in other positions or stages of a publishing line but the function of such apparatus is for an entirely different purpose, when compared with the novel use made of such apparatus in the novel system embraced by the present invention.

BRIEF DESCRIPTION OF THE DRAWINGS

FIG. 3 is a diagramatic representation of a magazine having a tear-out invoice and a remittance envelope integrated into the back cover of the magazine;

FIG. 4 is a diagramatic representation of a magazine having a calender rack integrated into the front cover of the magazine;

DETAILED DESCRIPTION OF THE INVENTION

Figure 1:
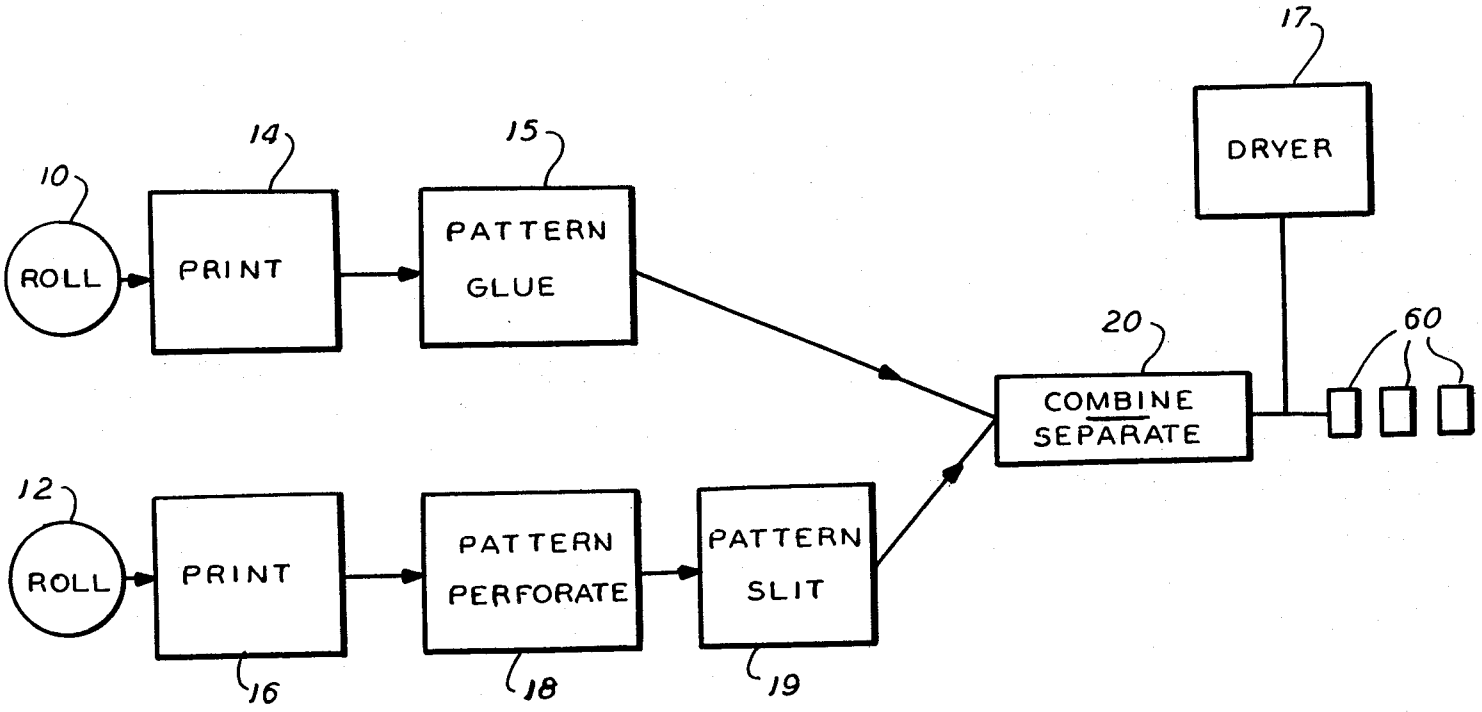
FIG. 1 is a block diagram of the system embracing the present invention.

Referring in general to FIG. 1, a block diagram of the system of the invention is represented where in two (2) rolls or webs of paper 10 and 12 are represented, each feeding into a printing or printer apparatus 14 and 16 respectively. The printing apparatus is preferably as an off-set printing press. The paper from roll 10 is then fed into a pattern gluing apparatus 15 which lays a pattern of glue strips on the surface of the paper. The glue patterning step may include one or more glue pattern applying apparatus and may include glue strips on both sides of the paper. One of the strips of glue may be remoistenable glue that may require drying. Other glue strip may be a pattern of wet glue to be used in the subsequent combining step. As to the remoistenable glue pattern, this glue strip, along with the ink type or printing may require a dryer 17 which dries the ink to prevent smearing and the remoistenable glue so that the adhesive characteristics of the glue are rendered inactive until remoistened.

The paper from 12 is fed into a printer 16, which may correspond to the printer 14. Printer 14 may include a drier. The paper 12 is then fed into a perforator 18 which cuts a perforated line pattern in the paper 12 and from the perforator, paper 12 is fed into a slitting apparatus or variable rotary cutter 19, which makes slits or cuts in the surface of the paper 12, in a predetermined pattern.

The papers 10 and 12 are fed into a combiner 20, which may include a register, acting upon each paper so that the sheets, when physically combined are in proper relation to each other. The combiner may include a plow folder or other paper folders so that the papers are folded over themselves and each other, for forming a magazine. The combiner 20 may also include a coupling device such as a stapler or gluer so that the spine of the folded papers may be coupled or secured together in preparation for separation. The combiner may also include a separator or cutter for separating the constructed units into individual pieces or magazines.

Figure 2:
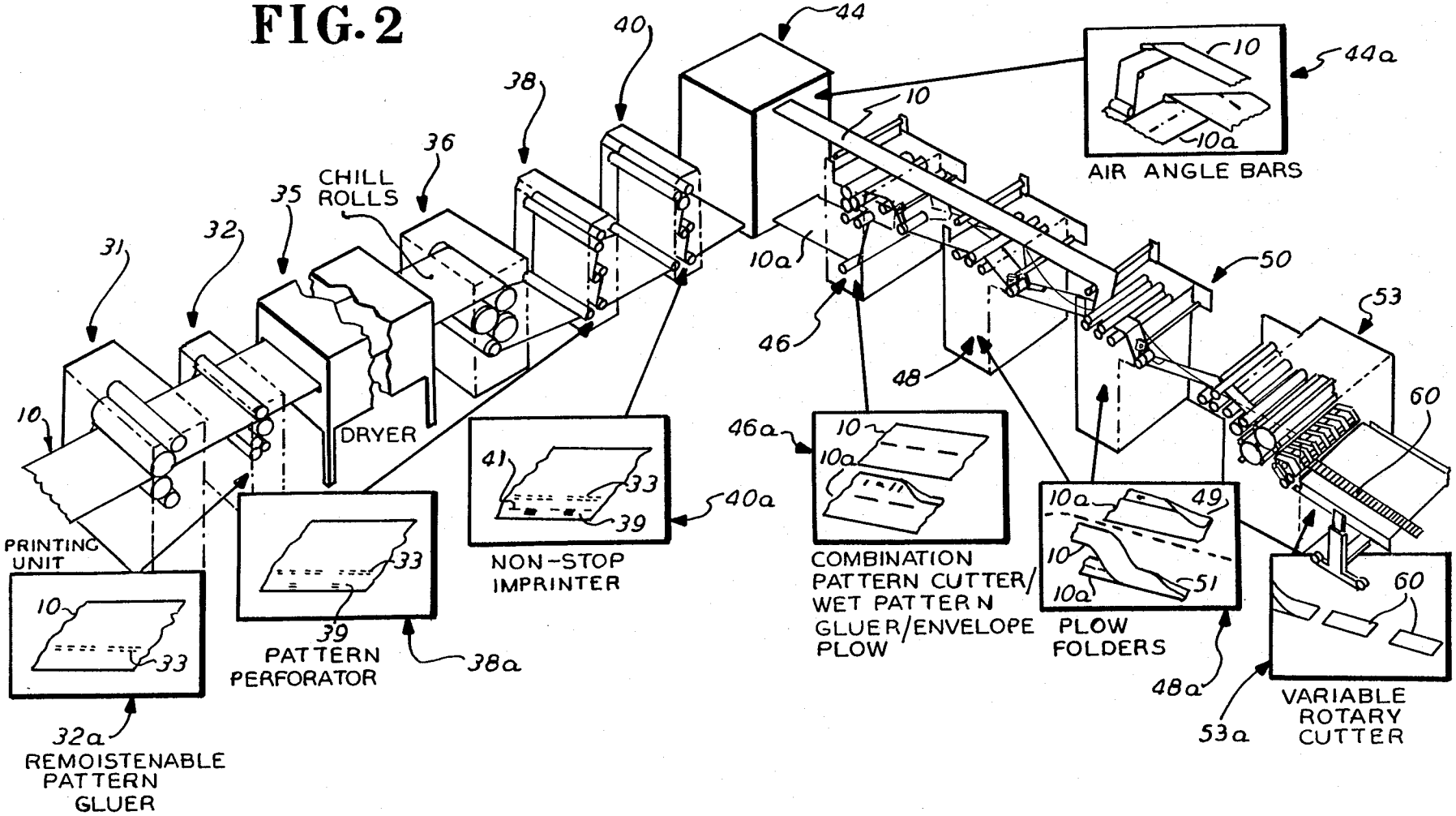
FIG. 2 is a pictorial representation of a preferred embodiment of a system embracing the invention.

FIG. 2 is a diagramatic representation, in a preferred embodiment, of the in-line production system, embracing the invention. The paper supply (not shown) which is preferably in a roll or web, is fed into printing units, which print predetermined indica or data on to both surfaces of the paper. Although only one printing unit 31, is shown, there may be more than one printing units which print data on the paper and may print several pages of a magazine in one run. The paper 10 continues in its travel and is fed into a remoistenable pattern gluer 32. This gluer applies a film of remoistenable glue in a predetermined pattern on to the paper 10 for forming, for example, a remoistenable glue strip for a remittance envelope. The strip of glue applied to the paper 10 is represented in window 32*a*, at 33. The paper continues through a dryer 35 which heat dries the ink printing and the glue strips. Drying the ink prevents smearing and drying the glue inactivates the glue. The chill rolls 36 cool the paper after heat drying. The paper is then fed pattern perforator 38 which cuts or punches in-line or cross perforations in the surface of the paper in a predetermined pattern. The pattern of perforations may form the tear-out portions of an invoice, for example and/or a tear-out envelope The window 38*a* shows representations of perforations, represented at 39, cut in the paper by the pattern perforator, 38.

The paper is fed through a non-stop imprinter 40 which imprints names, addresses and invoice data on the paper. This data is represented in window 40*a* and 41. The non-stop imprinter may be computer controlled and print different data for each magazine printed by the in-line run. The data could include the name and address of the subscriber to whom the particular m;agazine is to be sent and that particular subscriber's billing data.

The paper is fed to the angle bars unit 44, which slit the paper lengthwise into two running sheets 10 and 10*a* and turns and realigns the now two lengths of paper for maximum flexibility and minimum waste in product design. The sheet 10*a* is fed into a combination pattern cutter/wet pattern gluer/envelope plow, 46 which cuts slits into the paper 10*a*, lays down wet glue strips and plow folding for in-line forming of envelope pockets, for example and closure of the invoice data for privacy. The paper 10*a* is further fed through plow folder 48 which folds the paper 10*a* as seen at 49 in window 48*a*. Both running sheets 10 and 10*a* are fed into the plow folder 50, which folds the sheets 10 and 10*a* and combines the paper, as seen at 51 in window 48*a*, essentially forming the unseparated magazines.

Referring to the combination pattern cutter/wet pattern gluer/envelope plow it will be appreciated that the pattern cutter can be programmed to cut lines or slits into the surface of the paper sheet both lengthwise and crosswise. Such a cutter may be used to cut a window in the paper surface for exposing the name and address of the subscriber when the sheet is folded over itself, as will be described. In the alternative, a die cutter may be used to punch or die cut a window in the surface of the paper, if desired.

It will be further appriciated that the marks and contours on the paper sheet 10 and 10*a* as shown in the various windows represent something done to or on the paper sheet.

The combined folded paper 10/10*a* is fed into a variable roary cutter 53 which cuts the unseparated magazines into individual pieces 60, thus forming the individual magazines.

The data printed by the imprinter 40 may include the name and address of the subscriber of the magazine. This data may be located in a particular position on the surface of the paper. The pattern cutter 46 may cut a window in the surface of the paper, the location of which is such that when the running sheet 10*a* is folded over itself, the address data shows through the window for automatic addressing of the envelope.

The concept of the invention provides that magazine page data are printed on the running sheet 10 and the sheet is folded into pages which are inserted into the cover of the magazine formed by the double sheet 10*a*, after having been folded. The invoice is addressed to the subscriber, the address of the subscriber imprinted on the invoice shows through the window cut in one of the sheets of the double sheet cover. Thus the address on the invoice also serves as the address for mailing purposes when sending the magazine (and the invoice) to the subscriber through the mail.

The folding of the running sheet 10*a* is such that the invoice is a tear-out sheet on the inside of the cover. The remittance envelope is a tear-out envelope comprising part of the cover.

Depending upon the size of the magazine, (for example, there are small magazines and large magazines) the front cover of the magazine may include a window and the inside of the front cover may be a tear-out invoice. The address on the invoice shows through the window in the front cover for mailing purposes. The back cover of a small magazine may be a tear-out remittance envelope. If the magazine is a large magazine, the invoice and remittance envelope may be designed into the back cover of the magazine.

It will be appreciated that if the magazine published and/or assembled were a catalog, for example, or some other magazine that was forwarded without subscription or unsolicited, there would be no need for an invoice. In lieu of an invoice the imprinter could be programmed to print an order blank, survey or some other form and the envelope could be used to send in an order or reply, for example.

It will be appreciated that the block diagram of FIG. 1 represents two rolls of paper 10 and 12 each being applied and fed into different, parallel processing lines while the preferred embodiment provides for one supply 10 and splits the running paper into two webs 10 and 10*a* in the processing unit 44. In the preferred system a wide paper 10 is used and is printed on both sides, printing all the pages of a magazine in a single run. Absolute control is maintained so long as the paper 10 is fed perpendicularly into the processing unit. The paper splitter and air angle bars unit 44 separates the running paper into two running sheets which are subsequently, at the paper or plow folder 50, combined and finally folded into unseparated, magazine units. The remaining processing includes the separating of the magazine units into individual magazines.

A positive advantage of the preferred system is that the same weight or type of paper is used for forming the entire magazine and all its integrated parts. Thus, the entire magazine is made from the same weight paper. Apparatus or units usable for practicing the invention as disclosed herein are available as follows:

(a) Printing Unit (3), an off set printer such as a Harris model #1000, is available from Harris Press Company;

(b) Remoistenable Pattern Gluer (32) is available from Baldwin Machine Company;

(c) Dryer (35) is available from Baldwin Machine Company;

(d) Chill Rolls (36) is available from Baldwin Machine Company;

(e) Pattern Perforator (38) is available from Baldwin Machine Company;

(f) Imprinter (40) a computer controlled printer, is available from Baldwin Machine Company and any computer compatable with the imprinter may be used;

(g) Air Angle Bars and Splitter (44) is available from Baldwin Machine Company;

(h) Pattern Cutter/Wet Gluer/Envelope Plow (46) is available from Baldwin Machine Company;

(i) Plow Folders (48 and/or 50) are available from Baldwin Machine Company; and, (j) Variable Rotary Cutter (53) is available from Baldwin Machine Company.

Referring now to FIGS. 3 and 4, representations of a magazine generated by the system is presented, FIG. 3 showing the inside of the back cover and FIG. 4 showing the inside of the front cover. It will be appreciated that the cover of the magazine 60 is of double thickness, folded such as seen at window 46*a* at 10*a*. Thus, the back cover is perforated along the lines 65 so as to make the envelope 66 separable from the cover. The perforated lines 67 and the slits 68 and 69 combine to form a tear-out invoice sheet, printed by the non-stop imprinter 40. A slit 70 forms the mouth of the envelope 66 while a remoistenable glue strip 71 is used to close and secure the envelope, when used. The window, shown in broken line form 73 is cut in the outside sheet of the double sheet cover.

Although FIG. 3 shows the inside of the back cover of a magazine made up to include the remittance envelope and the invoice it will be appreciated that the remittance envelope may be located on one cover, either the back or the front while the invoice may be located on the other cover, either the front or the back, of the same magazine.

FIG. 4 represents the inside of the front cover, which is formed into a programmable rack for a calander month, for example May 1987. The slits 80, 81, 82, 83, 84 and 85 are on the inside sheet of the double sheet cover while glue strips laid on the inside of the outside sheet of the double sheet cover, just above the slits 81, 82, 83, 84 and 85 and at the bottom edge of the cover sheets, secure the two sheets 10 and 10*a* and form a plurality of horizontal pockets across the inside cover. The pockets are segmented into seven segments representing the days of the week. Obviously, if the remittance envelope and the invoice were separated so as to be located in the inside of the back cover and the front cover respectively the program rack, as represented in FIG. 4 would be eleminated from the inside cover of the magazine.

Sheet 90 is made into a plurality of stamps, which may be cut-out stamps or may be separable along perforated and/or slit lines so as to be tear-out stamps. The stamps may be cut out or torn out and placed in the horizonal pockets on the inside of the front cover, in or at an appropriate date indication. Since the inside cover serves as a month calander, a person may program a month of television shows he wishes to see.

The stamps may identify television presentations or movies to be presented over television. The front of the stamp may identify the name of the presentation, the back of the stamp may give the channels, dates and times when the identified program will be presented or broadcast over television. By inserting a stamp in the appropriate pocket or slot, at the appropriate date, this combination forms a personal programmable television programmer, integrated into the magazine.

This rack and stamp are disclosed in more detail in copending application Ser. No. 079,597 by the same inventor.

There has been described, with reference to the drawings, an in-line publishing or processing system for making a magazine, catalog, booklet or other publication wherein billing elements, such as an invoice, for example and a remittance envelope are integrated into the magazine, with automatic address feature. The preferred embodiment utilizes a single line, in-line system using a single or common supply or web of paper while an alternate embodiment describes parallel in-line systems which use a dual roll paper supply. In each of the above described systems the paper supply is in the form of a roll, or web of predetermined, uniform width and having length measured in the thousands of feet.

The present invention may also be used where the paper supply is in sheet form, such as a stack of sheets of paper of predetermined size. Sheets may be removed from a supply stack, one at a time by a sheet differentiator and individually fed through the in-line magazine publishing system. Depending upon the size of the magazine published and the size of sheet of paper used, the entire magazine may be made from the same sheet of paper, the paper being of any weight processable by the apparatus used in the system. Obviously where a roll of same weight paper is the supply, the entire magazine is made from the same weight paper. The paper weight or thickness is determined by the processing capability of the apparatus used in the system, that is, the weight of paper used can be no lighter or thinner than the highest or heaviest low limit of paper weight usable or handlable by any unit or piece of apparatus in the system. The present system achieves the publishing or making of a magazine, catalog, booklet, or other publication using a paper of 25 lb directory stock.

Figure 5A:
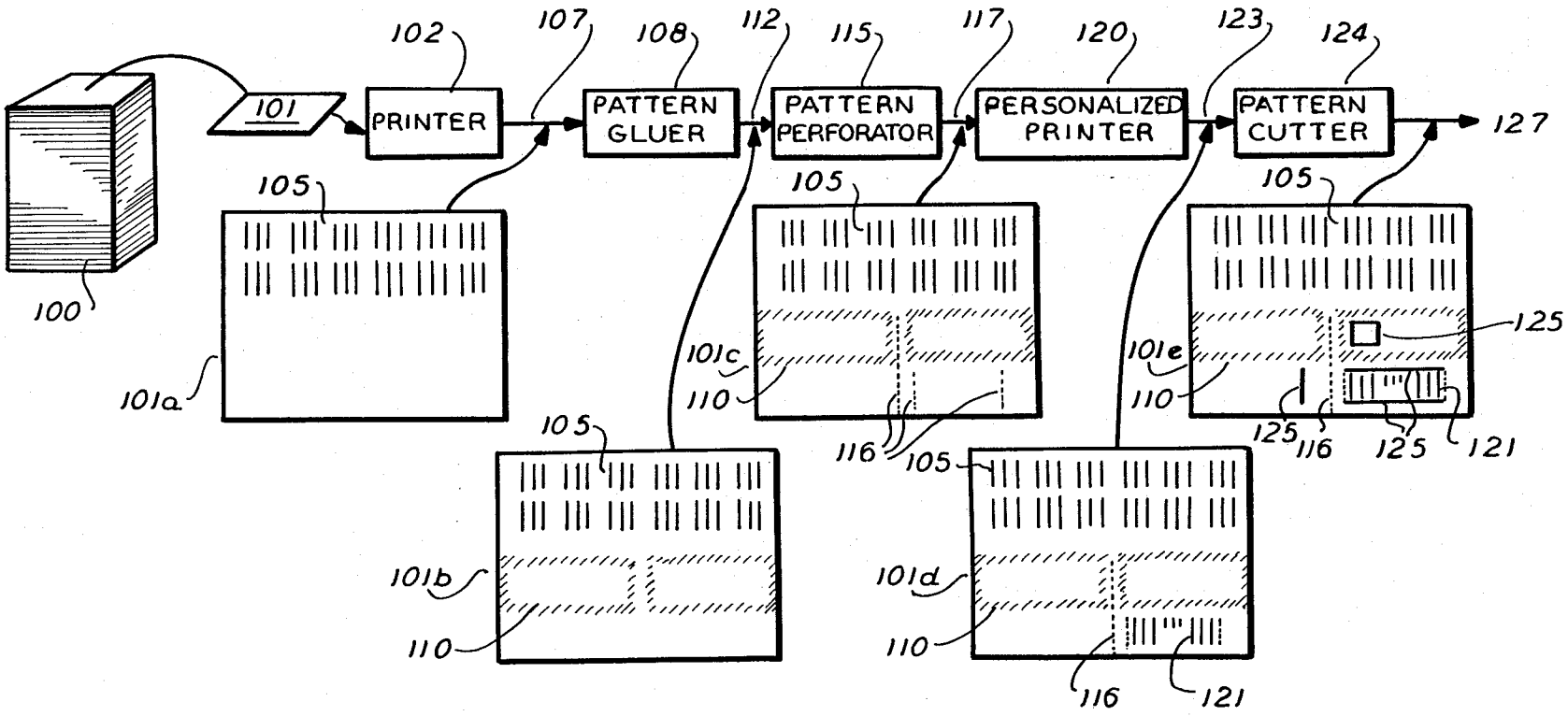
FIGS. 5*a* and 5*b* combine to form a block diagram of an alternate system embracing the present invention.
Figure 5B:
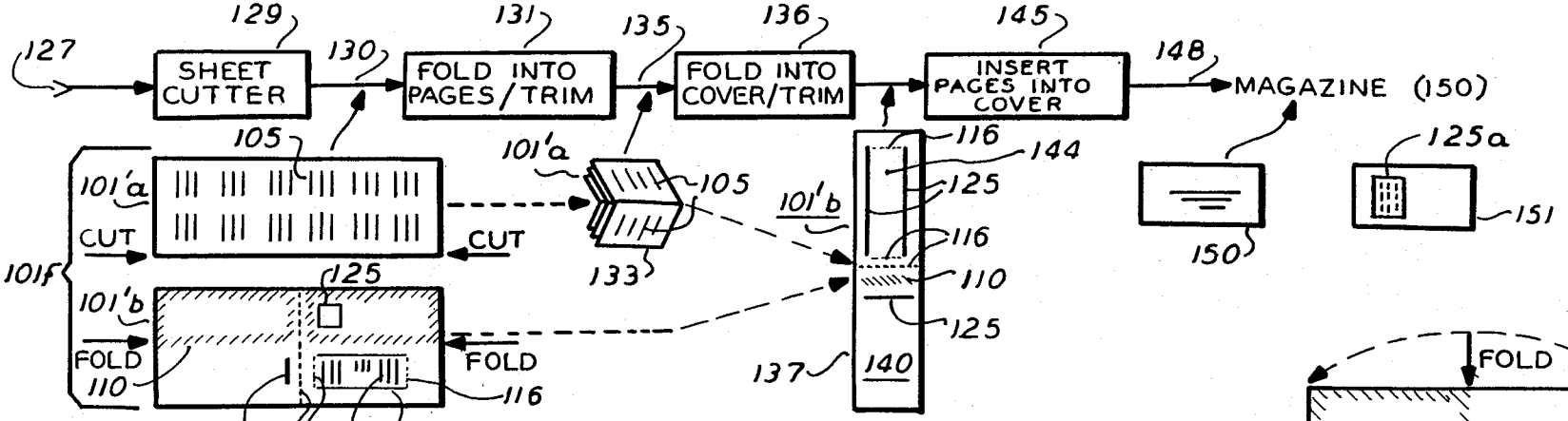

Referring now to FIGS. 5*a* and 5*b* an alternate system is represented in block diagram, illustrative form showing an in-line magazine publishing or printing assembly system in which single sheets of paper are processed by an in-line system, making a magazine, catalog, booklet or other publication in which billing elements and remittance envelopes are formed and assembled as an integral part of the covers of the magazine.

In FIG. 5*a*, a stack of paper sheets 100, all substantially the same size serves as the paper supply. The individual sheets of paper are separated or differentiated from the stack, either the top or the bottom and each sheet 101 is fed into the sheet processing system preferably starting with a printer 102. The printer 102 may be any printer set up to print on the paper on either a single side or on both sides of the sheet. The sheet may be printed with a plurality of pages, and, according to the size of the magazine printed, may print all of the pages of a magazine, catalog or booklet in a single run.

The sheet, also represented at 101*a*, has printed thereon the printing 105, when the sheet comes out of the printer at 107. The sheet is fed into a pattern gluing device 108 which lays down a pattern of glue strips 110, the pattern being predetermined and identical for each sheet. The sheet 101*b* represents the sheet exiting from the pattern gluer 108 at 112. The sheet is fed into a pattern perforator 115 which punches or cuts a predetermined pattern of perforations 116 into the sheet such as represented for example, on 101*c*. The sheet 101*c* represents the processed sheet at 117. A personalized printer 120 imprints billing data on the sheet such as represented at 121 on sheet 101*d*. Sheet 101*d* appears at position 123 with imprints 121. The personalized printed may be in the form of a computer controlled printer which prints names, addresses and billing data, individual to the subscriber to whom the particular published unit will be sent. As will be described below the name and address printed here will be the name and address to which the particular magazine will be mailed.

The sheet is fed into a pattern cutter which is programmed to cut predetermined slits in the sheet such as represented at 125 on 101*e*. The sheet 101*e* represents the sheet at position 127. The pattern cutter may be a slit cutter or slitter and/or a die cutter which cuts slits in the surface of the sheet, as programmed and cuts a window in the sheet as programmed and represented at 125.

For convenience the block diagram continues on FIG. 5*b*. The sheet is fed into a sheet cutter 129, which cuts sheet 101*f* into 101'*a* and 101'*b*, for individual processing.

At position 130, the sheet 101'*a* is fed in to folding/-trimming device 131, such as a series of folding devices, which fold and trim the sheet 101'*a* into folded pages, such as 133. The folded pages unit 133 appears at position 135. The sheet 101'*b* is fed into folding device and trimmer 136 which folds the sheet 101'*b* into a double sheet structure held together by the glue pattern 110. The sheet 101'*b* is folded at the arrow FOLD represented on sheet 101*f* so that the sheet 101'*b* is folded over itself and is glued together in double sheet structure. As represented at 137 and seen clearly in FIG. 6*b*, an envelope 140 is formed being torn off along one of the perforated lines 116. The slit 125 serving as the mouth of the envelope and a remoistenable glue strip 110 may be use to secure or close the envelope 140. A tear-out portion 144 is also formed with the personalized printed data on the inside of the tear-out sheet. The slits 125 and perforated lines 116 provide the tear-out feature. Both the pages 133 and the cover 137 are combined by inserting the pages into the cover and securing the pages therein as represented at 145, the unit magazine 150 emerging at position 148.

The front of the magazine is represented at 150 while the back of the magazine is represented at 151.

Figure 6A:
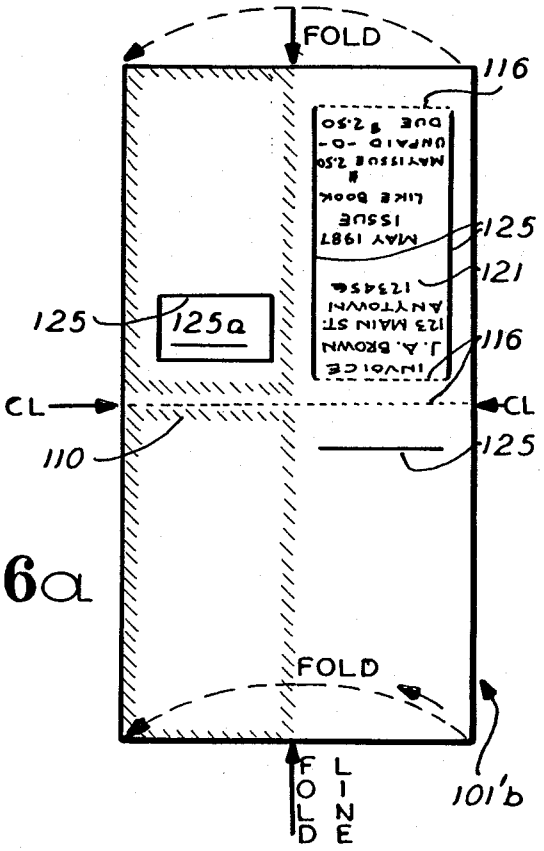
FIGS. 6*a* and 6*b* illustrate in more detail the unfolded and folded invoice/address section and the tear-out remittance envelope formed in the cover of a magazine.
Figure 6B:
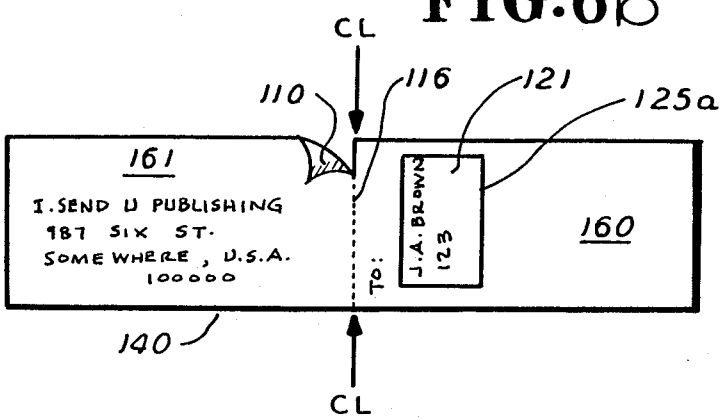

FIG. 6*a* represents and discloses in more detail the unfolded sheet 101'*b*. It will be seen that the sheet when folded at the FOLD line will convert into a double sheet such as represented at FIG. 6*b*. The invoice is printed on one part of the sheet while the glue pattern and window are processed in the other part of the sheet such that when the two parts are folded over each other, the name and address on the invoice appear through the window. This is represented in FIG. 6*b*.

The cover sheet 101'*b* is represented as being folded at the center line CL so as to form the cover for the magazine.

The surface 160 may be printed into a front cover, designed so that the mailing address, showing through the window is compatable with the remainder of the cover. The surface 161 may be printed and designed as the back cover where the address for the remittance envelope is prominent when the envelope is used as a return envelope.

Thus there has been described and represented a preferred embodiment of a system employing the principals of the invention and providing a magazine, catalog, booklet or other publication having billing elements and a remittance envelope integrated into the cover of the magazine. In addition an alternate system has been represented using a roll paper or web paper supply. A further alternate system has been described and represented in which the paper supply is in cut, stacked paper form where the individual sheets of paper are processed in an in-line system practicing the invention.

Although particular processing units in the preferred embodiment of the in-line publishing or processing system have been located with respect to each other, and have been identified, other units performing similar functions may be substituted therefore and changes and modifications over those systems disclosed may be made, as will be apparent to those skilled in the art, without departing from the spirit of the invention.

What is claimed is:

1. A method for making a magazine into which is integrated billing elements and a remittance envelope comprising the steps of:

(a) feeding a length of printable material from a supply into a printing unit for printing pages of a magazine in units on at least a first part of said material as said material passes through said printing unit;

(b) passing said printable material through a pattern gluer for laying down a pattern of glue associated with each unit of printed magazine pages on at least a second part of said material;

(c) passing said printable material through a pattern perforator for perforating a pattern of perforations on at least a third part of said material, associated with each said unit of printed magazine pages;

(d) passing said printable material through a pattern slitter for slitting a pattern of slits in said material on at least said third part of said material, associated with each said unit of printed magazine pages;

(e) folding said printable material over itself so that said second part overlays said third part for forming a lamination of said printable material by at least some of the glue pattern layed down on said printable material for forming billing elements and a remittance envelope and, (f) further folding said printable material over itself so that the portions of said printable material on which the printed pages are printed form the pages of a magazine inside said lamination.

2. A method of making a magazine as in claim 1 and further including the step of:

(a) passing said printable material into a slitter for cutting said printable material along its length for making two lengths of said material one length including at least said first part and the other length including at least said third part and said second part.

3. A method of making a magazine as in claim 1 and further including the step of passing the folded printable material into a cutter for cutting said folded material into units forming individual magazines.

4. A method for making a magazine into which is integrated billing elements and a remittance envelope comprising the steps of:

(a) feeding a length of web from a supply into a printer for printing pages of a magazine in sequential units on at least a first part of said web, as said web passes through said printer;

(b) passing said web through a pattern gluer for laying down a pattern of glue strips associated with each unit of printed magazine pages on at least a second part of said web;

(c) passing said web through a pattern perforator for perforating a pattern of perforations on at least a third part of said web, a pattern of perforations associated with each unit of printed magazine pages;

(d) passing said web through a pattern slitter for cutting a pattern of slits into at least a part of said third part of said web part of each said pattern of perforation and part of each said pattern of slits combining for defining a tear-out portion of each of said units;

(e) passing said web through a second printer for printing at least billing data on to said tear-out portion;

(f) passing said web through a slitter for slitting said web length wise into first and second webs, said first web including said first part and said second web including said second part and said third part;

(g) folding said second web over itself for forming a double sheet with said pattern of glue strips on the inside so that said double sheet is glued together in a pattern, defining at least a remittance envelope and tear-out invoice sheet;

(h) folding said first web into pages of a magazine and into said second web whereby said second web forms a cover of said magazine and (i) passing the folded webs into a cutter for cutting said folded webs into individual magazines.

5. An in-line method of publishing a magazine from a common supply of paper web wherein billing elements and a remittance envelope are integrated into the magazine comprising the steps:

(a) printing the pages of the magzine as a unit, in groups of units on said paper web as the web passes through a printer;

(b) setting down on said web a predetermined pattern of glue stripes associated with each said unit;

(c) cutting a predetermined pattern of perforated lines in said web associated with each said unit;

(d) cutting a predetermined pattern of slits in said web associated with each said unit;

(e) separating said paper web longitudinally into a first web and a second web, said first web including the pages of magazine units thereon, said second web including said predetermined pattern of glue stripes, said predetermined pattern of perforated lines and said predetermined pattern of slits thereon;

(f) folding said second web over itself whereby the glue stripes are on the inside of the fold so that the folded paper adheres together in a pattern defining at least an envelope and a tear-out portion;

(g) folding said first web over itself for aligning the pages of each magazine unit into a magazine array and folding each magazine array into the folded said second web for forming unseparated magazine units; and (h) separating the magazine units from each other for forming individual magazines.

6. A method of making a magazine, catalog, booklet or other book-type publication in an in-line paper processing system wherein billing elements and remittance envelopes are integrated into the cover of said magazine, catalog, booklet or other book-type publication comprising the steps of:

(a) feeding paper from paper supply into a printing unit for printing pages of a magazine on a first portion of said paper, the printed pages being printed in units on said paper as said paper passes through said printing unit;

(b) feeding said paper into a pattern gluer for laying down a predetermined pattern of glue for each printed unit, said pattern of glue layed down on a second portion of said paper, related to said first portion;

(c) feeding said paper into a pattern perforator for cutting a pattern of perforations in said second portion of said paper, said pattern of perforations for each predetermined pattern of glue;

(d) feeding said paper into a pattern cutter for cutting a pattern of slits in said second portion of said paper, said pattern of slits for each predetermined pattern of glue;

(e) feeding said paper into a paper cutter for cutting said paper for separating said first portion from said second portion;

(f) feeding said first portion of said paper into a folder for folding said first portion into page-like form for forming printed pages of said magazine;

(g) feeding said second portion of said paper into a folder for folding said second portion over itself for forming a double sheet with said pattern of glue on the inside of said double sheet for securing said double sheet for forming an envelope removable from said double sheet along a perforated line cut in said second portion of said paper by said pattern perforator and for forming a tear-out portion defined by two perforated lines cut in said second portion of said paper by said pattern perforator and two slits cut in said second portion of said paper by said pattern cutter; and (h) combining said first portion in page-like form with said second portion in double sheet form for forming a magazine unit in which said double sheet form is the cover of said magazine.

7. A method of making a magazine as in claim 6 and further including the steps of feeding said magazine unit into a cutter for separating said magazine unit from said paper supply.

8. A method of making a magazine as in claim 6 and further including a step between steps (d) and (e), the included step comprising;

feeding said paper into an imprinter for printing billing data on to said second portion for forming an invoice, said invoice being in tear-out form defined by two slits and two perforated lines cut into said second portions of said paper.

9. A method of making a magazine, catalog or other booklet into which is integrated billing elements and a remittance envelope in a continuous, in-line system comprising the steps of:

(a) feeding a portion of a paper supply into a printing apparatus for printing pages of a magazine on at least a first part of said portion of said paper;

(b) feeding said portion of said paper supply into a pattern gluer apparatus for laying down a predetermined pattern of glue on at least a second part of said portion of said paper;

(c) feeding said portion of said paper supply into a pattern perforator for cutting a predetermined pattern of perforations in said portion in at least said second part of said portion of said paper;

(d) feeding said portion of said paper supply into a pattern cutter for cutting a predetermined pattern of slits in said portion in at least said second part of said portion of paper;

(e) feeding said portion of said paper into an imprinter apparatus for printing billing data on said portion in said second part thereof;

(f) feeding said portion of said paper into a paper cutting apparatus for cutting said portion longitudinally for separating said first part of said portion from said second part of said portion;

(g) feeding said first part of said portion into a folding apparatus for folding said first part of said portion of said paper into a page-like arrangement;

(h) feeding said second part of said portion into a folding apparatus for folding said second part over itself with said predetermined glue pattern on the inside of the fold for forming a laminated sheet;

(i) feeding said first part and said second part of said portion of said paper supply into a combiner apparatus for combining said first part, in page-like form, into said second part for forming said magazine where said second part serves as the cover of said magazine; and (j) feeding the combined first part and second part of said first portion in to a cutting apparatus for cutting said first portion from said paper supply for separating said magazine from said paper supply.

10. A system for processing a paper supply into a magazine in which an invoice, remittance envelope and mailing address for the magazine are integrated into the cover of said magazine, said system comprising:

(a) a paper supply on which said magazine is to be printed and from which said magazine is to be made;

(b) first printing means and means for feeding paper from said paper supply into said first printing means for printing data relating to said magazine onto a first part of said paper;

(c) pattern gluer means and means for feeding said paper into said pattern gluer means for laying down a predetermined pattern of glue on to a second part of said paper;

(d) perforator means and means for feeding said paper into said perforator means for perforating a pattern of lines into said second part and a third part of said paper;

(e) second printing means and means for feeding said paper into said second printing means for printing invoice data on to said third part of said paper;

(f) paper cutting means and means for feeding said paper into said paper cutting means for cutting at least a pattern of slits into the surface of said third part of said paper and for cutting a window into the surface of said second part of said paper;

(g) second paper cutting means and means for feeding said paper into said second paper cutting means for cutting said paper into two parts for separating said first from said second and third parts;

(h) first paper folding means and means for feeding said first part of said paper into said first paper folding means for folding said first part of said paper into pages of said magazine;

(i) second paper folding means and means for feeding said second and third parts of said paper into said second paper folding means for folding said second part over said third part for forming a cover of said magazine said second part adhered to said third part by said pattern of glue layed down onto said second part, said second part and said third part being folded so that at least part of said invoice data printed on said third part appears through said window cut into said second part; and, (j) means for combining said pages with said cover for forming said magazine in which is integrated an invoice and a name and address to which said magazine may be sent.

11. A system for processing a paper supply as in claim 10 and in which said pattern gluer lays down a wet pattern of glue and and said system further includes:

(a) drying means and means for feeding said paper into said drying means after having been printed with said indicia and having received said pattern of glue for drying the ink forming the printing and for drying at least part of said pattern of glue for inactivating the glue.

12. A system for processing a paper supply as in claim 10 and in which said paper supply is a roll of paper.

13. A system for processing a paper supply as in claim 10 and in which said paper supply is a stack of cut paper and the individual sheets are processed by the system individually.

14. A system for processing a paper supply as in claim 10 and in which at least part of the lines of the pattern of perforated lines and at least part of the slits of the pattern of slits combine to form a tear out sheet located on said third part of said paper.

15. A system for processing a paper supply as in claim 14 and in which said invoice data is printed on said tear-out sheet.

16. A system for processing a paper supply as in claim 14 and in which said invoice data includes a name, an address and billing information and said name and said address appear through said window when said second part of said paper is folded over said third part of said paper.

* * * * *